United States Patent [19]

Grant

[11] 4,064,914

[45] Dec. 27, 1977

[54] POROUS METALLIC LAYER AND FORMATION

[75] Inventor: Andrew Campbell Grant, Williamsville, N.Y.

[73] Assignee: Union Carbide Corporation, New York, N.Y.

[21] Appl. No.: 744,416

[22] Filed: Nov. 23, 1976

Related U.S. Application Data

[60] Continuation of Ser. No. 467,936, May 8, 1974, abandoned, which is a division of Ser. No. 74,131, Sept. 20, 1970, Pat. No. 3,821,018, which is a continuation-in-part of Ser. No. 865,512, Oct. 10, 1969, abandoned.

[51] Int. Cl.[2] ..... F28F 13/18; F16L 9/14; F28F 21/08

[52] U.S. Cl. ..... 138/142; 138/145; 165/133; 165/180; 165/DIG. 10

[58] Field of Search ..... 165/133, 177, 180, DIG. 10; 138/142, 143, 177, DIG. 4, 145, 146

[56] References Cited

U.S. PATENT DOCUMENTS

| | | | |
|---|---|---|---|
| 2,744,011 | 5/1956 | Samuel et al. | 165/180 |
| 3,170,512 | 2/1965 | Smith | 165/180 |
| 3,384,154 | 5/1968 | Milton | 165/133 |
| 3,460,612 | 8/1969 | Valyi | 165/180 |
| 3,493,042 | 2/1970 | Burne et al. | 165/180 |
| 3,789,915 | 2/1974 | Ford | 165/133 |

*Primary Examiner*—Richard E. Aegerter
*Assistant Examiner*—Richard R. Stearns
*Attorney, Agent, or Firm*—John C. LeFever

[57] ABSTRACT

A metallic porous layer is formed on copper or copper alloy base material by providing a loose coating of copper or steel powder matrix, bonding metal alloy consisting of copper and phosphorous, or copper and antimony and a liquid binder, partially heating to evolve the liquid binder and further heating to 1350°-1550° F. to braze the bonding metal alloy to the base material and matrix.

2 Claims, No Drawings

POROUS METALLIC LAYER AND FORMATION

BACKGROUND OF THE INVENTION

This is a continuation of application Ser. No. 467,936 filed May 8, 1974, now abandoned, which in turn is a division of application Ser. No. 074,131 filed Sept. 20, 1970, issued as U.S. Pat. No. 3,821,018, which in turn is a continuation-in-part of application Ser. No. 865,512 filed Oct. 10, 1969, now abandoned.

This invention relates to a method for forming a thin porous copper or steel layer on copper or copper alloy base material, and an article comprising copper or copper alloy tube with a porous copper layer.

A thin layer of metal particles bonded together and to a metal base material as a uniform matrix with interstitial interconnected pores of equivalent pore radii less than about 6 mils is described in U.S. Pat. No. 3,384,154 issued May 21, 1968 to R. M. Milton. This patent also demonstrates that the porous layer is highly effective for transferring heat from a heat source thermally associated with the base material to boiling liquid within the layer; heat transfer coefficients were obtained on the order of 10 times greater than those for mechanically roughened surfaces.

The Milton patent describes a method for preparing porous heat transfer layers by sintering a metal powder matrix component onto the base material using a plastic binder for initial adhesion of the particles from a slurry. Sintering is accomplished by raising the temperature of the coated surface to the softening point of the base metal and the powder matrix component. In some instances this method results in considerable deformation of the base metal, e.g. thin copper alloy sheets or long tubing. Such deformation must be avoided where the porous metal layer-base metal is to be mass produced within closely controlled and reproducible dimensions, e.g. for assembly in heat exchanger tube sheets and casings. If annealing occurs, an additional work hardening step may be required to provide an article of satisfactory strength.

Another disadvantage of the sintering method is the relatively long period required to heat the copper base material and powder matrix to its softening point, i.e. above about 1760° F., and maintain the components at this high temperature level to achieve sintering. The same disadvantage exists with copper alloys, e.g. 1 wt.-% iron in copper. This characteristic not only time-limits mass production but also requires very high heat or power inputs.

It is an object of this invention to provide an improved method for forming a thin porous copper or steel layer on copper or copper alloy base material.

Another object is to provide a method which does not require the high bonding temperature characteristic of the prior art sintering methods for forming porous layers.

Still another object is to provide a method for forming thin copper porous layers on the walls of long copper tubes without substantial annealing and consequent tube deformation.

A further object is to provide a more rapid method for forming porous copper layer-copper base structures which also requires less heat.

A still further object is to provide an undeformed copper tube having a copper porous layer on at least one surface.

Other objects and advantages of this invention will be apparent from the ensuing disclosure and appended claims.

SUMMARY

Pure copper metal begins to anneal at about 700° F. and is fully annealed at 1200° F. For example, the yield strengths of copper at 90° F. before and after annealing at 1460° F. are about 10,000 psi. and 6,000 psi. respectively. Because the formation of a copper porous layer requires heating the base material to this high (1460° F.) temperature range, certain copper alloys can be used instead of commercially pure copper as the base material. These copper alloys become annealed at considerably higher temperatures than pure copper, but even their usage does not eliminate the problem of reduced strength and consequent deformation when the conventional sintering method is used to form the porous layer.

While deoxidized high phosphorous (DHP) copper may be used the copper alloy preferred as the base material in the practice of this invention is identified as No. 192 by the Copper Development Association (CDA) and comprises 98.7 wt.% Cu (minimum), 0.8–1.2% Fe, 0.01–0.04% P, and 0.10% (maximum) other constituents. This copper alloy has the following physical properties after heating at 1460°–1475° F.:

Tensile strength = 38,000 psi. minimum

Yield strength = 14,000 psi. minimum (0.5% extension under load)

Elongation = 35% minimum in 2 inches

It is apparent that copper alloy CDA No. 192 is not annealed at 1460° F.; this copper alloy does not start annealing until 1500° F. and is fully annealed at 1600° F. Another suitable copper alloy having a similar temperature-annealing relationship is CDA No. 194, containing 2.1–2.6% Fe (iron). Unfortunately the annealing temperatures of even these copper alloys are below the temperature required for copper sintering.

In the method of this invention, a loose coating is provided on copper base material comprising metal matrix powder, bonding metal alloy powder and an inert liquid binder vehicle. The bonding metal alloy powder consists of either 90.5–93 weight % copper and 7–9.5 weight % phosphorous or 25–95 weight % antimony and the balance copper. The bonding metal alloy powder also comprises 10–30 weight % of the copper matrix-bonding metal alloy total. The copper matrix and bonding metal alloy are each in particulate form sufficiently small to pass through a 30 mesh screen and be retained on a 500 mesh screen, based on the United States standard screen series. Moreover, the size range of substantially all copper matrix and bonding metal alloy particles of a particular loose coating do not exceed 250 mesh. Accordingly, if the largest particles pass through a 50 mesh screen the smallest particles are retained on a 300 mesh screen. The loose coating includes as a third major component, an inert liquid binder vehicle, as for example a mixture of viscous hydrocarbon binder and petroleum base solvent, e.g. a 50—50 weight % mixture of isobutylene polymer and kerosene.

The copper base material and loose coating are partially heated in a non-oxidizing atmopshere to temperature below 1000° F. to evolve the liquid binder and form a dried matrix-bonding metal alloy coating on the base material. As used herein, the expression "non-oxidizing atmosphere" means a gas atmosphere containing insufficient oxygen to permit oxidation of the copper alloy base material, the copper powder matrix or the bonding metal alloy powder at the elevated environment temperature. If these components have not been previously cleaned of oxide coating in a suitable solvent, as for example phosphoric or chromic acid, a reducing atmosphere such as hydrogen is preferred to effect such cleaning. If the components have been deoxidized immediately prior to practice of this method, the heating atmosphere may be inert, as for example nitrogen gas, although a reducing gas could also be employed.

After the partial heating step, the coated base material is further heated in a non-oxidizing atmosphere preferably at a higher rate than the partial heating and the maximum temperature of 1350°–1550° F., and only for sufficient duration to melt the bonding metal alloy and enable it to braze together the base material and the matrix powder. A layer of matrix particles less than 0.125 inch thick is formed in random stacked relation as a uniform structure with interstitial and interconnected pores between adjacent particles having pore radii between 0.05 and 7.5 mils. The porous layer coated base material is immediately cooled from the maximum temperature to below 1350° F. to prevent overbrazing which reduces the layer's porosity. That is, the copper-phosphorous or copper antimony bonding metal melts during the final heating step and forms an alloy with the outer surface of the copper, copper alloy or steel matrix and base material, e.g., the initial melting point of the bonding metal is about 1330° F. If the heating is continued above 1550° F., it has been found that the surface alloy itself begins to melt, flow into and close the pores which are essential to obtain the high boiling heat transfer coefficient.

This method has been successfully used to form a copper porous layer on the outer surface of long copper alloy tubes in 2 hours, whereas the prior art sintering method required 7 hours. Even more importantly, the tubes used as the copper alloy base material in the practice of this method substantially retained their original dimensions, in marked contrast to tubes of the same length coated by the sintering method. This was accomplished without significantly altering the tensile and yield strengths of the base material.

The porous layer coated base material prepared by the aforedescribed method also constitutes part of this invention.

Another aspect of the invention relates to an article of manufacture comprising a 0.8 – 2.6 weight % iron-in-copper alloy tube of grain size below about 0.05 mm. The tube has a porous layer less than 0.125 inch thick on at least one surface, comprising copper or steel particles of 30–500 mesh in random stacked relation as a uniform structure with interstitial and interconnected pores between adjacent particles, and preferably having pore radii of 0.05 – 7.5 mils. The particles are brazed together and to the tube surface by a bonding metal alloy having a melting point below 1500° F. The bonding metal alloy may for example be the aforedescribed 90.5 – 93% Cu and 7 – 9.5% P, or alternatively may be a bronze brazing composition such as the Handy-Harman flux No. 560 comprising 56 weight % silver, 22% copper, 17% zinc and 5% tin or 25 – 95% antimony and the remainder being copper. Such porous layered tubes are characterized by high tensile strength, and low percent elongation and deformation as compared to prior art articles.

DESCRIPTION OF PREFERRED EMBODIMENTS

An essential characteristic of porous layers for boiling heat transfer is interconnected pores of capillary size, some of which communicate with the outer surface. Liquid to be boiled enters the subsurface cavities through the outer pores and subsurface interconnecting pores, and is heated by the metal forming the walls of the cavities. At least part of the liquid is vaporized within the cavity and resulting bubbles grow against the cavity walls. A part thereof eventually emerges from the cavity through the outer pores and thence rises through the liquid film over the porous layer for disengagement into the gas space over the liquid film. Additional liquid flows into the cavity from the interconnecting pores and the mechanism is continuously repeated.

The high boiling coefficient results from the fact that the heat leaving the base metal surface does not have to travel through an appreciable liquid layer before meeting a vapor-liquid surface producing evaporation. Within the porous layer, a multitude of bubbles are grown so that the heat, in order to reach a vapor-liquid boundary, need travel only through an extremely thin liquid layer having a thickness considerably less than the minute diameter of the confining pore. Vaporization of liquid takes place entirely within the pores and substantially no superheating of the bulk liquid is required or can occur.

It will be apparent from the foregoing description that the porous layer must be structurally stable, reasonably uniform throughout its cross-section, with interconnected pores of capillary size having a controllable and reproducible equivalent pore radius. As used in this context, the "equivalent pore radius" emperically defines a porous boiling layer, having varied pore sizes and non-uniform pore configurations, in terms of a single average pore dimension. In general, for boiling liquids having relatively low surface tension such as the cryogens oxygen and nitrogen, the equivalent pore radius is preferably relatively small, e.g., between 0.05 and 2.5 mils. Conversely with boiling liquids having relatively high surface tension such as water, the equivalent pore radius should be relatively large, e.g., between 1.5 and 7.5 mils, the required equivalent pore radius being a function of pressure as well as surface tension.

A bonding metal alloy powder used in the copper porous layer formation method consists of 90.5 – 93 weight % copper and 7 – 9.5 weight % phosphorous. This particular mixture range is characterized by low melting temperature below about 1500° F., so that it melts below the softening points of the copper alloy base material and metal powder matrix. Accordingly it may be used to fuse these two components together and form a strong metallurgical alloy bond without appreciable softening (and annealing) of the copper alloy base material. A preferred bonding alloy mixture is 92 weight % copper and 8% phosphorous as it provides an initial melting point of about 1330° F.

Antimony can be used in place of phosphorous with the same melting point temperature lowering effect described for phosphorous. A useful range of antimony by weight percent has been found to be from 25 to 95.

The matrix powder can comprise copper, steel or copper alloys such as brass or bronze. Steel, which can be defined as a metal having Fe as its major constituent, has been found to be useful in place of copper with substantially the same result. It has been found that the metal bonding alloy powder forms a coating on the steel matrix powder thereby bonding the steel particles to each other and to the copper base material.

Generally, copper base material can be defined as including pure copper and metallic mixtures containing copper and up to 35 weight % alloying metal. The term DHP copper is used by the Copper Development Assn., Inc., 405 Lexington Avenue, New York, New York, to identify deoxidized high phosphorous copper which is a relatively pure copper having high residual phosphorous.

Both the copper powder matrix and the bonding metal alloy particles must be sufficiently small to pass through a 30 mesh screen. Although the particles may be any shape, e.g. spherical, granular or even thin flakes, they must be smaller than 30 mesh size to produce pores in the porous layer to become active as nucleation sites for boiling at low temperature differentials. Larger particles produce porous layers having equivalent pore radii larger than 7.5 mils. On the other hand, the copper matrix and bonding metal alloy particles must be sufficiently large to be retained on a 500 mesh screen. Smaller particles produce porous layers having equivalent pore radii which are too small for bubble release.

In general, large particles produce porous layers having relatively large equivalent pore radii, which in turn are preferred for boiling liquids having relatively high surface tension. The converse is also true. It should be noted, however, that there is no precise correlation between matrix and bonding metal particle size and equivalent pore radii. This is partly because the individual particles used to prepare a given porous layer are not necessarily the same shape, nor do these particles necessarily correspond in shape to the particles of different mesh size used to prepare other porous layers. Moreover, the particles are stacked in random relation on the base metal and sizes of the interstitial and interconnecting pores may vary considerably. The equivalent pore radius for a particular porous layer as described herein is determined by the following method: one end of the porous layer is vertically immersed in a freely wetting liquid and the capillary rise of the liquid is measured along the surface of the porous boiling layer as a function of time and correlated thereafter to the approximate equivalent pore radius.

In addition to the 30–500 mesh particle size range for metal matrix particles and bonding metal alloy particles useful in this method, for any particular embodiment substantially all particles of each component are preferably within a size range of 250 mesh. That is, the largest particles are within 250 mesh of the smallest particles. This relationship ensures that the porous boiling layer is substantially uniform in all directions. If the component particle sizes vary more than 250 mesh, there is a tendency for the smallest particles to preferentially settle in a strata nearest the copper alloy base and the largest particles to form a top strata. For example, if the bonding metal alloy particles are much smaller than the matrix metal particles many of the latter would not intimately contact the copper alloy base material. Conversely if the matrix metal particles are much smaller than the bonding metal alloy particles, primarily the former contact the base material. In either event the resulting porous metal layer is characterized by relatively low boiling coefficients (because of an excessively wide range of equivalent pore radii) and low strength (because of nonuniform particle distribution and low brazing strength). Particle sizes in the range of 100–325 mesh have been found satisfactory to form a porous boiling layer of about 1.5 – 2.0 mils equivalent pore radii, preferred for boiling relatively low surface tension liquids as for example the halogenated hydrocarbon refrigerants, air, oxygen and nitrogen.

In a preferred embodiment, the powder matrix and bonding metal alloy powder are provided in substantially the same particle size distribution so as to form high strength porous layers and a high boiling heat transfer coefficient on a copper alloy base which retains its original dimensions, shape and high non-annealed tensile and yield strengths.

The bonding metal alloy comprises 10 to 30 weight % of the matrix powder bonding metal alloy total. The lower limit of this range is based on the requirement of sufficient metal alloy to wet both the copper alloy base material and the copper, copper alloy or steel matrix powder, and form strong metal alloy bonds between the matrix particles and the base material. The 30 weight % bonding metal alloy upper limit is to avoid the presence of so much of the latter that excessive alloying or erosive action occurs during the brazing, thereby preventing formation of the small equivalent pore radii necessary to enhance boiling heat transfer.

In a preferred embodiment of the instant method the bonding metal alloy powder comprises about 17.5 weight % of the copper matrix bonding metal alloy total.

The function of the inert liquid binder is to adhere the metal powder matrix and bonding metal alloy powder to the copper alloy base material at the coating temperature so that the base material may be moved and positioned within a furnace, if desired. Suitable binders must be liquid at ambient temperature, inert (or chemically non-reactive) with respect to the other components of the loose coating, and preferably have moderately high volatility and low latent heat. Various plastics may be used to suspend the metal matrix and bonding metal alloy as for example an isobutylene polymer having a molecular weight of about 140,000 and known commercially as "Vistanex," dissolvable in solvents such as kerosene. The preferred binder is a 50 weight % Vistanex - 50 weight % kerosene mixture. Other organics such as toluene, methyl alcohol, ethyl alcohol or acetone may be used as a dissolving and/or thinner material. The latter preferably boils in the moderately high range of 300°–550° F. so as to avoid evaporation before bonding has been initiated. A stabilized cut of petroleum distillate is suitable from this standpoint.

Although not essential, a binder may be selected which also temporarily suspends the metal matrix and bonding metal alloy powders and forms a slurry preferably having a paintlike consistency. In this event the quantity of binder-vehicle is determined to afford a slurry of desired viscosity, preferably about 3000 centipoise for producing porous layers about 8–12 mil thick. The slurry form is particularly convenient to form the loose coating in relatively inaccessible copper alloy base material areas, as for example the inner surface of tubing.

To obtain a strong mechanical bond between the porous layer and the base material, the latter should be degreased by washing with a suitable agent as for example carbon tetrachloride.

As used herein, the step of providing a "loose coating" of copper powder matrix, bonding metal alloy powder and liquid binder contemplates all methods of application without appreciable external pressure, e.g. spraying, dipping the copper alloy base metal into one or more fluids, or pouring one or more of the components onto the base material. The porous layer is characterized by substantially interconnecting pores, and such open structure may not be prepared from a compacted or extruded layer.

In a preferred method embodiment, the copper alloy base material is first coated with a uniform thickness film of the liquid binder as for example by dipping, painting or spraying. A uniform mixture of copper powder matrix and bonding metal alloy powder is thereafter applied as a coating of substantially uniform thickness to the binder film. The coating may be formed in several steps by shaking off excess unadhered powder mixture after each application and thereafter sprinkling on an additional layer of powder. This sequence has been found highly satisfactory in providing strong metal bonds between the three essential components. The final layer has substantially uniform effective pore radii and reasonably constant thickness.

This sequential method for forming a thin porous copper layer on copper alloy base material is not my invention but is disclosed and claimed in a copending application Ser. No. 037,649 entitled "Two Step Porous Boiling Surface Formation" filed May 15, 1970 by Robert A. Weiner and Arthur Rodgers and issued Aug. 21, 1973 as U.S. Pat. No. 3,753,757.

It is also preferred but not essential to apply an additional light coating of matrix powder after the primary loose coating of liquid binder-matrix powder-bonding metal alloy has been formed. The purpose of this final coating of matrix powder is to reduce the possibility of excessive alloying or erosion of primary matrix powder by the bonding metal alloy, by providing additional powder which the outermost bonding metal alloy may preferentially attack.

Alternative satisfactory sequences for providing the loose coating on the copper alloy base metal include first applying the bonding metal alloy powder and then a matrix powder-binder mixture, or first applying a matrix powder-binder mixture and then the bonding metal alloy powder.

Once the loose coating has been formed on the base material the composite is partially heated in a non-oxidizing atmosphere to temperature below about 1000° F. but sufficient to evaporate the liquid binder and form a dried matrix bonding metal alloy coating on the base material. Heating may be indirect, e.g. by hot gas surrounding the coated base material, or direct as by using the latter as the heating element in the electrical circuit and controlling the voltage and current. For indirectly heated furnaces wherein the coated material is stationary, the partial heating step is preferably conducted at a rate not exceeding 600° F. per hour; higher rates tend to evaporate the binder so rapidly as to lift or entrain powder in the evolving vapor. Such is undesirable, both from the standpoint of losing the powder and also possibly changing the relative quantities of matrix powder and bonding metal alloy as the particles are lifted by the vapor. For such furnaces, it is preferred to conduct this first heating step at rate of about 400° F. per hour. Heating rates above 600° F. per hour may be preferred in furnaces where the coated base material is directly heated and/or moved through the furnace (See Example V). The partial heating is below about 1000° F. as suitable liquid binders are completely evolved at 1000° F. and the heating rate may be increased in the final heating step without deleterious effects.

As previously indicated, the partial heating step may be performed in either a chemically inert atmosphere such as nitrogen, or a reducing atmosphere as for example hydrogen. Although not essential, a small quantity of brazing flux such as borax-base type may be included in the loose coating. The brazing flux should not comprise more than about 5 weight % of the matrix powder bonding metal alloy total. These fluxes act as a solvent for the copper oxide coating on the base material so that if a flux is employed, a reducing atmosphere may not be required for either of the heating steps even if the base material is not precleaned with solvent.

In the second or final heating step, the dry coated base material is further heated in a non-oxidizing atmosphere preferably at faster rate than the first heating step to maximum temperature of 1350° F.-1550° F. This final heating step is only for sufficient duration to melt the bonding metal alloy and enable it to braze together the base material and the matrix, and form a layer of particles less than 0.125 inch thick in random stacked relation as a uniform structure with interstitial and interconnected pores between adjacent particles having pore radii between 0.05 and 7.5 mils. The heating rate of this step should not be so high as to exceed the desired maximum temperature for an appreciable period. If this were to occur the base material would become at least partially annealed and characterized by reduced tensile strength and high percent elongation - the same disadvantages of copper porous layer base materials prepared by the sintering method. Also, excessive exposure to the maximum temperature causes overbrazing and flow of the bonding metal copper alloy into the pores as previously discussed. On the other hand, for mass production and high efficiency of manufacturing the final heating rate should be as high as possible and is preferably 1,000°-2,000° F. per hour in indirectly heated furnaces wherein the work is stationary.

It has been found that the time-temperature relationship during the last part of the final heating step is an important consideration in producing a high quality article. For example, a relatively lower maximum temperature may be satisfactory if the coated base material is exposed to such temperature for a relatively longer period. Also, the surface oxidative condition of bonding metal alloy powder may affect the duration and maximum temperature of the final heating step. If the bonding metal alloy has been exposed to the oxidizing atmosphere for a long period, a relatively longer and hotter final heating step is required to remove the oxide and form the bonding metal copper alloy bond. In general, the final heating should be terminated prior to reaching the maximum temperature to avoid exceeding same for an appreciable period.

The gas environment during the final heating step should also be non-oxidizing. If the bonding metal alloy has a substantial oxide coating the gas should be reducing, i.e., hydrogen-containing, to remove the oxide. Although not essential, it is convenient and preferable to employ the same gas atmosphere during the partial and further heating steps.

To avoid even partially annealing the base material, the final article is immediately cooled from the maximum temperature of the final heating step to below 1350° F. This can be accomplished by terminating the heating and preferably also circulating cool air around the furnace retort.

The invention will be more fully understood by the following examples:

EXAMPLE I

This example illustrates the method of this invention, whereby a copper porous layer was formed on the outer surface of one inch outside diameter tubes composed of 99% copper - 1% iron. The tubes were 5 feet long for ultimate use in a heat exchanger.

The outside surface of the tubes was washed with a degreasing solvent and air dried. The cleaned tubes were then horizontally positioned and a 50—50 weight-% mixture of isobutylene polymer and kerosene liquid binder was poured over the tube outer surface, the tubes being rotated as needed to insure complete coverage. The binder-coated horizontal tubes were drained for 10–12 minutes to remove excess liquid, horizontally rotated 180° and held stationary for another 10 minutes to allow the liquid binder to spread evenly over the tube's outer surface. Bonding metal alloy powder comprising 92% by weight copper and 8% phosphorous was mixed with pure copper powder in proportions to form a mixture comprising 82.5% by weight copper powder matrix and 17.5% bonding metal alloy of 100–325 mesh particle size. The powder mixture was sprinkled over the liquid binder-coated tube surface, the latter being aligned horizontally and slowly rotated during the sprinkling to insure even coverage. The coated tube was then shaken to remove any unadhered powder. This powder sprinkling and tube shaking sequence was repeated three times at 1 hour intervals, after which the tubes were placed horizontally on racks in a furnace and heated at a rate of about 400° F. per hour to about 1000° F. in a hydrogen gas atmosphere to evaporate the binder. The coated tubes were then further heated at a rate of about 500° F. per hour in the same hydrogen gas atmosphere to about 1475° F. and thereafter immediately cooled within the furnace by terminating the heating and air cooling the exterior of the retort enclosing the tubes and surrounding hydrogen atmosphere.

The porous layer comprising copper matrix and copper-phosphorous alloy was about 0.020 inch thick and characterized by pore radii of about 1.5 - 2.0 mils. When used as a heat transfer surface for boiling water, the heat transfer coefficient was about 5000 Btu/hr ft$^2$ ° F. — about 10 times greater than for mechanically roughened surfaces and similar to the coefficients obtained with porous layers prepared by the sintering method. Another 17 mil thick porous layer on a 99% copper - 1% iron tube prepared according to this procedure afforded a boiling heat transfer coefficient of about 4,770 Btu/hr. ft$^2$ for fluorotrichloromethane at 18-inches vacuum and 13,500 Btu/hr. ft$^2$ heat flux. Again this performance was comparable to a porous layer prepared by sintering.

The tubes were not distorted by this heating despite their long length. The strength integrity of the porous layer was tested by scraping and wire brushing procedures, and found to be equivalent to porous layers prepared by the sintering method and acceptable by commercial standards.

EXAMPLE II

This series of tests illustrates the importance of the 1,550° F. upper limit for the second or further heating step of the instant method. The procedure was identical to that of Example I, except that instead of 1,475° F., the maximum heating temperature for three different groups of coated tubes was 1,550° F., 1,575° F. and 1,600° F. Examination of the tubes clearly indicated that as heating temperature was increased beyond 1550° F. melting closed at least some of the pores, produced a bumpy layer and destroyed the uniform and controllable pore radii characteristic of highly efficient boiling layers.

EXAMPLE III

This series of tests illustrates the effect of copper matrix - 92% copper - 8% phosphorous bonding metal alloy mixture proportions and particle size on the strength and performance of porous layers prepared in accordance with the Example I procedure for boiling fluorotrichloromethane. The porous layers were formed on discs with a maximum heating temperature of 1500° F. and thereafter inserted in a pool boiling test unit. The tests are summarized as follows:

| Disc No. | Bonding Metal wt. % | Mixture size range size range | Strength Strength | Layer Thickness-mils | Boiling Coef.* |
|---|---|---|---|---|---|
| 1 | 15 | 140–400 | very good | 16 | 3000 |
| 2 | 20 | 140–400 | excellent | 11 | 4240 |
| 3 | 15 | 140–325 | very good | 15 | 3550 |
| 4 | 20 | 140–325 | excellent | 13 | 4590 |
| 5 | 15 | 140–270 | very good | 13 | 4000 |
| 6 | 20 | 140–270 | excellent | 14 | 3960 |

*Measured at 18-inches vacuum and heat flux of 13,500 Btu/hr. ft$^2$

Comparing the 15 and 20 weight % bonding metal samples, the higher bonding metal content is preferred because of higher strength and at least equivalent boiling heat transfer coefficients. The 20 weight % bonding metal 140–325 mesh powder mixture afforded substantially higher performance than either the wider cut (140–400 mesh) or the narrower cut (140–270 mesh).

EXAMPLE IV

This series of tests illustrates preparation of the article of this invention using as the bonding metal alloy, a silver-rich mixture comprising 56 weight % silver, 22% copper, 17% zinc and 5% tin. A 15-inch long ¾ inch outside diameter 99% copper-1% iron tube was cleaned in acetone. Each end was painted with the aforedescribed 50—50 weight % mixture of isobutylene polymer and kerosene binder. End "A" was dusted with a 5 weight % silver alloy - 95 weight % copper powder matrix of about 100–450 mesh size until no more powder adhered to the binder. End "B" was dusted with a 10 weight % silver alloy - 90 weight % copper powder matrix of about 100–450 mesh size in the same manner. The tube was then partially heated in a furnace and in a hydrogen atmosphere at rate of about 400° F. per hour to about 900° F. to evaporate the binder and thereafter finally heated at rate of about 500° F. per hour in the same hydrogen atmosphere to 1350° F–1400° F. The coated tube was maintained at this temperature level for about 1 hour and without excessive melting because it was not sufficiently close to the bonding metal-copper alloy melting temperature to produce overbrazing.

On examination, the coating on each end appeared uniform and porous. The 10 weight % silver alloy coating was slightly stronger than the 5 weight % silver alloy coating but both could be scraped off by hand. Microscopic examination confirmed that insufficient bonding metal alloy had been used to form a strong porous layer.

In a subsequent test, a powder mixture comprising 20 weight % of the same silver-rich bonding metal alloy and 80 weight % copper matrix of about 100–450 mesh particle size was dusted over the same binder coating onto a copper disc. The coated disc was heated to 1400° F. using the aforedescribed program. The strength and integrity of the resulting porous layer was tested by scraping and wire brushing procedures and found to be equivalent to porous layers prepared by sintering. The porous layer was tested in a pool boiling unit using fluorochloromethane at 5.7 psia. at 13,500 Btu/hr. ft$^2$ heat flux and provided a heat transfer coefficient of about 4,600 Btu/hr. ft$^2$ ° F. — comparable to a sintered copper porous layer under the same conditions. For purposes of this test, the use of pure copper instead of copper-iron alloy base material was not significant.

EXAMPLE V

This series of tests illustrates both the method of manufacture and the article, and compares same with the prior art sintering method and article.

Two samples of 1-inch outside diameter tube each 2.25 feet long and composed of 99% copper - 1% iron were provided. The outer surface of one tube was coated with pure copper powder of 100–325 mesh particle size and the outer surface of the second tube was coated with the same 82.5% by weight copper powder matrix - 17.5% bonding metal alloy mixture of 100–325 mesh particle size used in Example I. The coating procedure was the same as outlined in Example I except that the fluid comprised a 50—50 weight % mixture of isobutylene polymer and petroleum distillate liquid binder, and was painted on (instead of poured over) the tube outer surface.

The coated tubes were placed in a mesh belt (chain grate) type electric furnace over two supports spaced 2 feet apart. The furnace was about 30 feet long with partial heating and further heating zones each 9 inches wide and 4 inches high. The partial heating zone of this furnace was about 7 feet long, the further heating zone was about 6.3 feet long and the cooling zone was about 14 feet long. The gas atmosphere for partial heating, final heating and cooling was 36% hydrogen and 64% nitrogen by volume, with a 30°–60° F. dew point.

Both coated tube samples were run at grate speed of 5 inches per minute through the furnace partial heating section. The partial heating rate was about 3300° F. per hour up to a maximum temperature of about 1000° F. The pure copper powder coated tube was moved through the further heating zone at a rate of 1 inch per minute and further heated to a maximum temperature of about 1825° F. for about 74 minutes. The copper-phosphorous powder coated tube was moved through the further heating zone at a rate of about 4 inches per minute and further heated to a maximum temperature of about 1525° F. for about 18 minutes. The further heating rates were not directly measured but were of the same order of magnitude as the partial heating rate, i.e., about 3300° F. per hour. After the further heating step, the coated tubes were moved through the cooling zone at a rate of about 4–5 inches per minute and the cooling rate was on the order of 2500° F. per hour.

After removal from the furnace, the vertical deformation of the center section from the supported end sections, hereinafter referred to as "maximum-Sag," was measured. Maximum sag is a criteria for evaluating the tube deformation resulting from the heating portion of the copper porous layer forming method. Grain size measurements of the tube metal were also made to evaluate the effect of heating on the tube strength. For these grain size measurements, the tubes were cut longitudinally along the tube center line and measurements made at right angles to the cuts following the procedure of ASTM No. E 112-63 "Tentative Methods for Estimating Average Grain Size of Metals," Appendix 4.

The results of these are as follows:

| Type of Porous Layer | Maximum Heating Temperature* F | Maximum Sag (inches) | Tube Grain* Size (mm.) | Porous Coating Pore Radii (mil) |
|---|---|---|---|---|
| Copper | 1825 | 9/16 | > 0.200 | 1.65 |
| Copper-Phosphorus | 1525 | 1/4 | 0.035–0.045 | 1.74 |

*Grain size for unheated 99% copper - 1% iron tube = 0.010 mm.

It is seen from this data that the present method permitted a substantially lower bonding temperature and provided an article characterized by less than one-half the deformation of articles prepared by the prior art sintering method. The deformation of the sintered copper porous layered tube was so great as to prevent its use in heat exchanger construction, whereas the copper-phosphorous porous layer tube may be so used. The data also indicated that whereas the present method for forming the copper porous layer only slightly increased the tube grain size, the prior art sintering method causing an over twenty- fold increase in grain size. In view of the well known relationship between metal grain size and strength, it is apparent that the porous copper layered tube of this invention has substantially the same strength as the unheated tube in marked contrast to the prior art sintered porous copper layered tube. It is significant that the ASTM No. B75-62 specification for seamless copper tube, light annealed, is an average grain size not exceeding 0.04 mm. Accordingly, the brazed article of this invention would be acceptable using this standard but the sintered article wholly unacceptable.

Another important advantage of this manufacturing method is the much higher production rate, e.g., the copper-phosphorous powder coated tube movement rate of 4 inches per minute as compared to the pure copper sintering method's rate of 1 inch per minute.

EXAMPLE VI

In another example of this invention wherein steel matrix powder is bonded to a copper substrate disc using phosphorous-copper bonding powder, a DHP copper disc and an iron-copper alloy tube CDA #192 (0.8–1.2% Fe, 0.01–0.04% P and 0.1% max other constituents) were coated with inert liquid binder as described in Example I and then coated with Glidden #4600 steel powder (1.9% Ni, .6% Mn, 0.3% Mo, .04% C, .3% Si and balance Fe) mixed with C-302 (92 wt.% Cu and 8 wt.% P) phosphorous-copper powder in a weight ratio of 75/25. All powders were 100–325 mesh. After partial furnace heating to 1000° F. the samples were heated to 1450°–1500° F. Bond strength of the porous coating on the copper disc and CDA #192 tube was good. Boiling tests made with R-11 (trichloromonofluoromethane C $Cl_3$ F) refrigerant at 1 atmosphere pressure using the coated copper disc gave a boiling side heat transfer coefficient of 5100 Btu/hr. ft$^2$ ° F. at a heat flux of 20,000 Btu/hr. ft$^2$ compared with a smooth surface heat transfer coefficient of less than about 1000 Btu/hr. ft²° F. From this and other similar experiments, it is believed that about 30% phosphorous-copper powder (C-302) and 70% steel matrix powder will provide good porous surface bonding. The coated copper substrate disc of this example heated to 1500° F. had an average longitudinal grain size of 0.050 mm as compared with 0.025–0.030 for the unheat-treated copper substrate disc.

EXAMPLE VII

In another example of this invention wherein copper matrix powder is bonded to a copper substrate disc using antimony-copper bonding powder, a bonding alloy powder comprising about 31% antimony and 69% copper by weight was prepared having 100–325 mesh size. This bonding alloy powder was then mixed with pure copper matrix powder, 100–325 mesh size in a weight ratio of 20% bonding powder to 80% matrix powder, coated onto a copper disc which had been coated with inert liquid binder as described in Example I and partially heated to about 1000° F. and thereafter heated to 1500°–1550° F. in a hydrogen atmosphere. The resulting porous surface was well bonded to the copper substrate. A boiling test using R-11 refrigerant at one atmosphere pressure showed a boiling side heat transfer coefficient of 7,400 Btu/hr. ft² ° F. at a heat flow per unit area of 20,000 Btu/hr. ft² compared with a smooth surface heat transfer coefficient of less than about 1000 Btu/hr. ft²° F. The coated copper substrate disc of this example heated to 1550° F had a range of longitudinal grain size of from 0.040 – 0.045 mm as compared with 0.025 – 0.030 for the unheat-treated copper substrate disc.

EXAMPLE VIII

In still another example of this invention tubes of cupronickel alloys (90% copper - 10% nickel and 70% copper - 30% nickel) were successfully coated on the outside with inert liquid binder as described in Example I and with pure copper matrix powder and 9% phosphorous - 91% copper bonding metal powder in a weight percent ratio of 80/20. All powders ranged from 100–325 mesh. The samples were partially heated to about 1000° F. and then brazed in nonoxidizing atmosphere at 1500° F. They demonstrated excellent properties in porous surface substrate bond strength. The average longitudinal grain size increase for the 90/10 cupronickel alloy was from about 0.015 mm to 0.045 mm. A boiling test using R-11 refrigerant at one atmosphere pressure showed boiling side heat transfer coefficients of about 6,000 Btu/hr. ft² ° F. for both samples at a heat flow rate of 20,000 Btu/hr. compared with a smooth surface heat transfer coefficient of less than about 1000 Btu/hr. ft²° F.

Although prferred embodiments of this invention have been described in detail, it is contemplated that modifications of the method and article may be made and that some features may be employed without others, all within the spirit and scope of the invention.

What is claimed is:

1. As an article of manufacture, a copper base material tube of grain size below approximately 0.05 mm. and a porous layer less than 0.125 inch thick on at least one surface of said tube comprising metal particles wherein said particles are of a material selected from the group consisting of copper, copper alloy and steel of 30–500 mesh size in random stacked relation as a uniform structure with interstitial and inteconnected pores between adjacent particles having equivalent pore radii of below approximately 7.5 mils, said particles being brazed together and to the tube surface by a bonding metal alloy consisting of approximately 56% silver, 22% copper, 17% zinc, and 5% tin by weight, having a melting point below 1500° F.

2. As an article of manufacture, a copper base material tube of grain size below approximately 0.05 mm. and a porous layer less than 0.125 inch thick on at least one surface of said tube comprising metal particles wherein said particles are of a material selected from the group consisting of copper, copper alloy and steel of 30–500 mesh size in random stacked relation as a uniform structure with interstitial and interconnected pores between adjacent particles having equivalent pore radii of below approximately 7.5 mils, said particles being brazed together and to the tube surface by a bonding metal alloy consisting of 25–95 weight % antimony, 5–75 weight % copper, comprising 10–30 weight % of the metal particle - metal alloy total and having a melting point below 1500° F.

* * * * *